US007227072B1

(12) United States Patent
Weare

(10) Patent No.: US 7,227,072 B1
(45) Date of Patent: Jun. 5, 2007

(54) SYSTEM AND METHOD FOR DETERMINING THE SIMILARITY OF MUSICAL RECORDINGS

(75) Inventor: Christopher B. Weare, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 548 days.

(21) Appl. No.: 10/439,876

(22) Filed: May 16, 2003

(51) Int. Cl.
*A63H 5/00* (2006.01)
*G04B 13/00* (2006.01)
*G10H 7/00* (2006.01)

(52) U.S. Cl. ..... 84/609; 84/600; 84/611; 84/615; 84/649; 84/651; 84/653

(58) Field of Classification Search ..... None
See application file for complete search history.

(56) References Cited

U.S. PATENT DOCUMENTS

| | | | | |
|---|---|---|---|---|
| 6,051,770 | A * | 4/2000 | Milburn et al. | 84/611 |
| 6,657,117 | B2 * | 12/2003 | Weare et al. | 84/668 |
| 2001/0025561 | A1 * | 10/2001 | Milburn et al. | 84/609 |
| 2002/0002899 | A1 * | 1/2002 | Gjerdingen et al. | 84/667 |
| 2003/0089218 | A1 * | 5/2003 | Gang et al. | 84/615 |
| 2005/0092165 | A1 * | 5/2005 | Weare et al. | 84/668 |

OTHER PUBLICATIONS

Byrd, D., and T. Crawford, "Problems of Music Information Retrieval in the Real World," *Information Processing and Management 38*:249-272, 2002.

Downie, J.S., "The Musifind Music Information Retrieval Project, Phase III: Evaluation of Indexing Options," *Proceedings of the Canadian Association for Information Science 23rd Annual Conference on Connectedness: Information Systems, People, Organizations*, Edmonton, Canada, Jun. 7-10, 1995, pp. 135-146.

Downie, S., and M. Nelson, "Evaluation of a Simple and Effective Music Information Retrieval Method," *Proceedings of the 23rd Annual International ACM SIGIR Conference on Research and Development in Information Retrieval*, Athens, Greece, Jul. 24-28, 2000, vol. 34, pp. 73-80.

Edwards, J.S., and C.H. Douglas, "Model Computer-Assisted Information Retrieval System in Music Education," *J. of Research in Music Education* 20(4):477-483, 1972.

(Continued)

*Primary Examiner*—Marlon Fletcher
(74) *Attorney, Agent, or Firm*—Christensen O'Connor Johnson Kindness PLLC

(57) ABSTRACT

A system and method for determining the similarity of music files based on a perceptual metric is disclosed. In accordance with one aspect of the invention, harmonic, rhythmic, and melodic components are generated for each of the music files. The dimensionality of the components is then reduced to six by a mapper. This reduction is part of what allows the present invention to process large collections of music files very quickly. The mapper maps the components to positions on two-dimensional feature maps. The feature maps are trained by a trainer. The top N positions in each feature map, along with their amplitudes, are taken as the representative vectors for the music files. To compare the similarity between two music files, the distance between the two representative vectors are calculated.

44 Claims, 10 Drawing Sheets

OTHER PUBLICATIONS

Kang, Y.-K., et al., "Extracting Theme Melodies by Using a Graphical Clustering Algorithm for Content-Based Music Information Retrieval," *Proceedings of the Advances in Databases and Information Systems, 5th East European Conference*, Vilnius, Lithuania, Sep. 25-28, 2001, pp. 84-97.

Kataoka, M., et al., "Music Information Retrieval System Using Complex-Valued Recurrent Neural Networks," *Proceedings of the 1998 IEEE International Conference on Systems, Man, and Cybernetics*, San Diego, Calif., Oct. 11-14, 1998, vol. 5, pp. 4290-4295.

Lippincott, A., "Issues in Content-Based Music Information Retrieval," *Journal of Information Science 28*(2):137-142, 2002.

Melucci, M., and N. Orio, "Evaluating Automatic Melody Segmentation Aimed at Music Information Retrieval," *Proceedings of the Second ACM/IEEE-CS Joint Conference on Digital Libraries*, Portland, Ore., Jul. 14-18, 2002, pp. 310-311.

* cited by examiner

800

| | S1 | S2 | S3 | S4 |
|---|---|---|---|---|
| M1 | 0.3125 | 0.3125 | 0.3125 | 0.34375 |
| M2 | 0.15625 | 0 | 0 | 0.78125 |
| R1 | 0.21875 | 0.25 | 0.25 | 0.65625 |
| R2 | 0.40625 | 0.21875 | 0.3125 | 0.8125 |
| T1 | 0.21875 | 0.96875 | 0.096875 | 0.71875 |
| T2 | 0.375 | 0.09375 | 0.3125 | 0.75 |

Fig.8.

900

| | S1 | S2 | S3 | S4 |
|---|---|---|---|---|
| S1 | 0 | 0.838 | 0.775 | 1.07 |
| S2 | 0.838 | 0 | 0.238 | 1.27 |
| S3 | 0.775 | 0.238 | 0 | 1.13 |
| S4 | 1.07 | 1.27 | 1.13 | 0 |

Fig.9.

SYSTEM AND METHOD FOR DETERMINING THE SIMILARITY OF MUSICAL RECORDINGS

FIELD OF THE INVENTION

The present invention relates to music information retrieval systems, and more particularly, a system and method for determining the similarity of music files based on a perceptual metric.

BACKGROUND OF THE INVENTION

In the field of music information retrieval, it is often desirable to be able to determine the degree of similarity between music files. For example, a user may have thousands of music files stored on a hard drive, and may wish to locate songs that "sound like" certain favorite songs. As another example, a Web service may wish to provide song recommendations for purchase based on the content of the music that is already stored on the user's hard drive. These examples illustrate a need to classify individual musical compositions in a quantitative manner based on highly subjective features, in order to facilitate rapid search and retrieval.

Classifying information that has subjectively perceived attributes or characteristics is difficult. When the information is one or more musical compositions, classification is complicated by the widely varying subjective perceptions of the musical compositions by different listeners. Different listeners may perceive a particular musical composition quite differently.

In the classical music context, musicologists have developed names for various attributes of musical compositions. Terms such as *adagio, fortissimo,* or *allegro* broadly describe the strength with which instruments in an orchestra should be played to properly render a musical composition from sheet music. In the popular music context, there is less agreement upon proper terminology. Composers indicate how to render their musical compositions with annotations such as brightly, softly, etc., but there is no consistent, concise, agreed-upon system for such annotations.

Musical compositions and other information are now widely available for sampling and purchase over global computer networks through online merchants such as AMAZON.COM®, BARNESANDNOBLE.COM®, CDNOW.COM®, etc. A prospective consumer can use a computer system equipped with a standard Web browser to contact an online merchant, browse an online catalog of pre-recorded music, select a song or collection of songs ("album"), and purchase the song or album for shipment direct to the consumer. In this context, online merchants and others desire to assist the consumer in making a purchase selection and desire to suggest possible selections for purchase.

A variety of classification and search approaches are now used. In one approach, a consumer selects a musical composition for listening or for purchase based on past positive experience with the same artist. This approach has a significant disadvantage in that artists often have music of widely varying types.

In another approach, a merchant classifies musical compositions into broad categories or genres. A disadvantage of this approach is that typically the genres are too broad. For example, a wide variety of qualitatively different albums and songs may be classified in the genre of "Popular Music" or "Rock and Roll."

In still another approach, an online merchant presents a search page to a client associated with the consumer. The merchant receives selection criteria from the client for use in searching the merchant's catalog or database of available music. Normally the selection criteria are limited to song name, album title, or artist name. The merchant searches the database based on the selection criteria and returns a list of matching results to the client. The client selects one item in the list and receives further, detailed information about that item. The merchant also creates and returns one or more critics' reviews, customer reviews, or past purchase information associated with the item.

For example, the merchant may present a review by a music critic of a magazine that critiques the album selected by the client. The merchant may also present informal reviews of the album that have been previously entered into the system by other consumers. Further, the merchant may present suggestions of related music based on prior purchases of others. For example, in the approach of AMAZON.COM®, when a client requests detailed information about a particular album or song, the system displays information stating, "People who bought this album also bought . . . " followed by a list of other albums or songs. The list of other albums or songs is derived from actual purchase experience of the system. This is called "collaborative filtering."

However, the use of this approach by itself has a significant disadvantage, namely that the suggested albums or songs are based on extrinsic similarity as indicated by purchase decisions of others, rather than based upon objective similarity of intrinsic attributes of a requested album or song and the suggested albums or songs. A decision by another consumer to purchase two albums at the same time does not indicate that the two albums are objectively similar or even that the consumer liked both. For example, the consumer might have bought one for the consumer and the second for a third party having greatly differing subjective taste than the consumer.

Another disadvantage of this type of collaborative filtering is that output data is normally available only for complete albums and not for individual songs. Thus, a first album that the consumer likes may be broadly similar to a second album, but the second album may contain individual songs that are strikingly dissimilar from the first album, and the consumer has no way to detect or act on such dissimilarity.

Still another disadvantage of collaborative filtering is that it requires a large mass of historical data in order to provide useful search results. The search results indicating what others bought are only useful after a large number of transactions, so that meaningful patterns and meaningful similarity emerge. Moreover, early transactions tend to over-influence later buyers, and popular titles tend to self-perpetuate.

In yet another approach, digital signal processing (DSP) analysis can be used to try to match characteristics from song to song. U.S. Pat. No. 5,918,223, assigned to Muscle Fish, a corporation of Berkeley, Calif. (hereinafter the Muscle Fish Patent), describes a DSP analysis technique. The Muscle Fish Patent describes a system having two basic components, typically implemented as software running on a digital computer. The two components are the analysis of sounds (digital audio data), and the retrieval of these sounds based upon statistical or frame-by-frame comparisons of the analysis results. In that system, the process first measures a variety of acoustical features of each sound file and the choice of which acoustical features to measure is critical to the success of the process. Loudness, bass, pitch, brightness, bandwidth, and Mel frequency cepstral coefficients (MFCCs) at periodic intervals (referred to as "frames") over the length of the sound file are measured. The per-frame values are optionally stored, for applications that require that level of detail. Next, the per-frame first derivative of each of these features is computed. Specific statistical measurements of each of these features are computed to describe their variation over time. The specific statistical measurements that are computed are the mean and standard deviation. The first derivatives are also included. This set of statistical measurements is represented as an N-vector (a vector with N elements), referred to as the rhythm feature vector for music.

Once the feature vector of the sound file has been stored in a database with a corresponding link to the original data file, the user can query the database in order to access the corresponding sound files. The database system must be able to measure the distance in N-space between two N-vectors.

The sound file database can be searched by four specific methods, enumerated below. The result of these searches is a list of sound files rank-ordered by distance from the specified N-vector, which corresponds to sound files that are most similar to the specified N-vector or average N-vector of a user grouping of songs.

1. Simile: The search is for sounds that are similar to an example sound file, or a list of example sound files.
2. Acoustical/perceptual features: The search is for sounds in terms of commonly understood physical characteristics, such as brightness, pitch and loudness.
3. Subjective features: The search is for sounds using individually defined classes. One example would be to be searching for a sound that is both "shimmering" and "rough," where the classes "shimmering" and "rough" have been previously defined by a grouping. Classes of sounds can be created (e.g., "bird sounds," "rock music," etc.) by specifying a set of sound files that belong to this class. The average N-vector of these sound files will represent this sound class in N-space for purposes of searching. However, this requires ex post facto grouping of songs that are thought to be similar.
4. Onomatopoeia: Involves producing a sound similar in some quality to the sound that is being searched for. One example is to produce a buzzing sound into a microphone in order to find sounds like bees or electrical hum.

While DSP analysis may be effective for some groups or classes of songs, it is ineffective for others, and there has so far been no technique for determining what makes the technique effective for some music and not others. Specifically, such acoustical analysis as has been implemented thus far suffers defects because 1) the effectiveness of the analysis is being questioned regarding the accuracy of the results, thus diminishing the perceived quality by the user and 2) recommendations are only generally made by current systems if the user manually types in a desired artist or song title, or group of songs from that specific Web site. Accordingly, DSP analysis, by itself, is unreliable and thus insufficient for widespread commercial or other use. Another problem with the DSP analysis is that it ignores the observed fact that oftentimes, sounds with similar attributes as calculated by a digital signal processing algorithm will be perceived as sounding very different. This is because, at present, no previously available digital signal processing approach can match the ability of the human brain for extracting salient information from a stream of data. As a result, all previous attempts at signal classification using digital signal processing techniques miss important aspects of a signal that the brain uses for determining similarity.

In addition, previous attempts at classification based on connectionist approaches, such as artificial neural networks (ANN), and Self-organizing Feature Maps (SOFM), have had only limited success classifying sounds based on similarity. This has to do with the difficulties in training ANN's and SOFM's. The amount of computing resources required to train ANN's and SOFM of the required complexity tend to be cost and resource prohibitive.

The present invention is directed to providing a system that overcomes the foregoing and other disadvantages. More specifically, the present invention is directed to a system and method for determining the similarity of musical recordings based on a perceptual metric.

SUMMARY OF THE INVENTION

A system and method for determining the similarity of music files based on a perceptual metric is disclosed. In accordance with one aspect of the invention, rhythmic, harmonic, and melodic components are extracted from music files and compared to determine the degree of similarity between the music files.

In accordance with another aspect of the invention, the invention is comprised of four elements, including a preprocessor, a mapper, a comparer, and a trainer. The preprocessor generates components of the music files. The mapper maps the components of the music files to two-dimensional feature maps. Based on the two-dimensional feature maps, representative vectors are then determined for each of the music files. To compare the similarity between two music files, the comparer compares the representative vectors of the music files. The trainer is used to train the mapper.

In accordance with another aspect of the invention, the preprocessor operates in three steps: generate harmonic components, generate rhythmic components, and generate melodic components. In the first step, generate harmonics, the music file is broken down into a frequency/time representations. This is a two-dimensional array of numbers. The value of each number represents the energy of the musical signal present in a given frequency bin. The vertical axis is the Mel frequency scale, although the vertical scale can represent any of the many "warped" frequency mappings that are used to more closely mimic the perceptual groupings of frequency bands that occurs in the human ear. The horizontal axis is time.

The harmonic components are then sent to the rhythmic component generator. The rhythmic component generator analyzes the activity in a number of critical frequency bands of the harmonic components. A Fourier transform is taken of the amplitude of each of these critical bands as a function of time. The result of this transform yields information on the period of periodically occurring signals. The average intensity of each bin in the transform along with the standard deviation of that intensity is calculated. Bins with intensity greater the average intensity plus some factor times the standard deviation of the intensity are preserved; all other bins have their intensity set to zero. The result of this truncation is returned by the rhythmic component generator.

The melodic component generator returns a data set that represents a two-dimensional decomposition of the musical partials present in the song. A musical partial is a harmonic component that is stationary for a given period of time. The result of the melodic component generator can be thought of as a primitive musical transcriber; turning the sounds into a rough representation of the notes played in the music. The collection component generators thus return a set of data that represents the three major components of music: timbre (a.k.a. harmonics), rhythm, and melody.

In accordance with another aspect of the invention, the mapper reduces the dimensionality of the input to six by mapping various found patterns within the output of the component generators to positions on one of three two-dimensional feature maps. Each of the three feature maps serves their respective component generators. The top N positions in each feature map, along with their amplitudes, are then taken as the representative vectors for the input music file. It will be appreciated that the reduction of the dimensionality of the input to six by the mapper is part of what allows the present invention to process large collections of music files very quickly. This in contrast to a system that utilizes very large feature vectors, such as one utilizing vectors on the order of 24 elements, just to describe one of the aspects of the music file, for which the processing requires a large amount of data.

In accordance with another aspect of the invention, in order to compare the similarity between two music files, the comparer calculates the distance between the two representative vectors. Small distances indicate that the music files are similar while large distances indicate that the music files are not similar.

In accordance with another aspect of the invention, in order to create the mapping of the feature maps, the trainer trains the feature maps. This is done using the standard self-organizing feature map training procedure. The outputs of the three component generators are repeatedly fed to the trainer for a large corpus of music files (e.g., 100,000 songs may be utilized in one example training procedure). One epoch represents the presentation of the entire set of songs. This process is repeated over several epochs until the maps converge to stable values. The result of the training process is stored in training files for use by the mapper.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 8 is a table illustrative of example pairs of numerical elements for each of the melody, rhythm, and timbre components for four music files; and FIG. 9 is a table illustrative of example numerical elements that represent the perceptual differences between each of the four music files of FIG. 8.

DETAILED DESCRIPTION OF THE PREFERRED EMBODIMENT

The present invention is directed to a system and method for determining the similarity of music files based on perceptual metrics. As will be described in more detail below, in accordance with the present invention the rhythmic, harmonic, and melodic components are extracted from the music files and compared to determine the degree of similarity between the music files.

Figure 1:
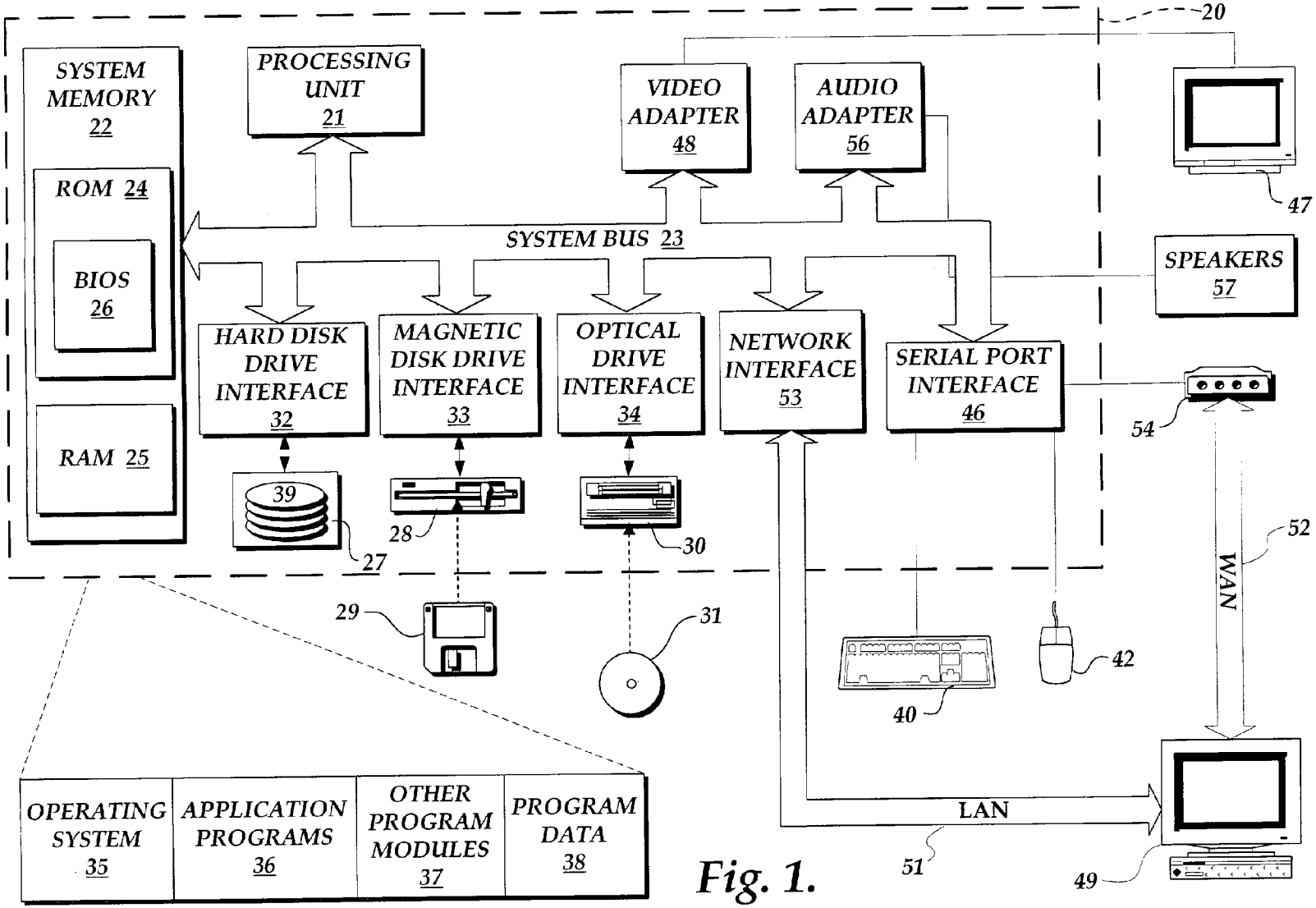
FIG. 1 is a block diagram of a general purpose computer system suitable for implementing the present invention.

FIG. 1 and the following discussion are intended to provide a brief, general description of a suitable computing environment in which the present invention may be implemented. Although not required, the invention will be described in the general context of computer-executable instructions, such as program modules, being executed by a personal computer. Generally, program modules include routines, programs, characters, components, data structures, etc., that perform particular tasks or implement particular abstract data types. As those skilled in the art will appreciate, the invention may be practiced with other computer system configurations, including hand-held devices, multiprocessor systems, microprocessor-based or programmable consumer electronics, network PCs, minicomputers, mainframe computers, and the like. The invention may also be practiced in distributed computing environments where tasks are performed by remote processing devices that are linked through a communications network. In a distributed computing environment, program modules may be located in both local and remote memory storage devices.

With reference to FIG. 1, an exemplary system for implementing the invention includes a general purpose computing device in the form of a conventional personal computer 20, including a processing unit 21, system memory 22, and a system bus 23 that couples various system components including the system memory 22 to the processing unit 21. The system bus 23 may be any of several types of bus structures including a memory bus or memory controller, a peripheral bus, and a local bus using any of a variety of bus architectures. The system memory includes read-only memory (ROM) 24 and random access memory (RAM) 25. A basic input/output system (BIOS) 26, containing the basic routines that helps to transfer information between elements within the personal computer 20, such as during start-up, is stored in ROM 24. The personal computer 20 further includes a hard disk drive 27 for reading from or writing to a hard disk 39, a magnetic disk drive 28 for reading from or writing to a removable magnetic disk 29, and an optical disk drive 30 for reading from or writing to a removable optical disk 31, such as a CD-ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer-readable media provide non-volatile storage of computer-readable instructions, data structures, program modules, and other data for the personal computer 20. Although the exemplary environment described herein employs a hard disk 39, a removable magnetic disk 29, and a removable optical disk 31, it should be appreciated by those skilled in the art that other types of computer-readable media which can store data that is accessible by a computer, such as magnetic cassettes, flash memory cards, digital video disks, Bernoulli cartridges, random access memories (RAMs), read-only memories (ROMs), and the like, may also be used in the exemplary operating environment.

A number of program modules may be stored on the hard disk 39, magnetic disk 29, optical disk 31, ROM 24 or RAM 25, including an operating system 35, one or more application programs 36, other program modules 37 and program data 38. A user may enter commands and information into the personal computer 20 through input devices such as a keyboard 40 and pointing device 42. Other input devices (not shown) may include a microphone, joystick, game pad, satellite dish, scanner, or the like. These and other input devices are often connected to the processing unit 21 through a serial port interface 46 that is coupled to the system bus 23, but may also be connected by other interfaces, such as a parallel port, game port or a universal serial bus (USB). A display in the form of a monitor 47 is also connected to the system bus 23 via an interface, such as a video card or adapter 48. One or more speakers 57 may also be connected to the system bus 23 via an interface, such as an audio adapter 56. In addition to the display and speakers, personal computers typically include other peripheral output devices (not shown), such as printers.

The personal computer 20 may operate in a networked environment using logical connections to one or more personal computers, such as a remote computer 49. The remote computer 49 may be another personal computer, a server, a router, a network PC, a peer device or other common network node, and typically includes many or all of the elements described above relative to the personal computer 20. The logical connections depicted in FIG. 1 include a local area network (LAN) 51 and a wide area network (WAN) 52. Such networking environments are commonplace in offices, enterprise-wide computer networks, intranets, and the Internet.

When used in a LAN networking environment, the personal computer 20 is connected to the local area network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20 or portions thereof may be stored in the remote memory storage device. It will be appreciated that the network connections shown are exemplary, and other means of establishing a communications link between the computers may be used.

Figure 2:
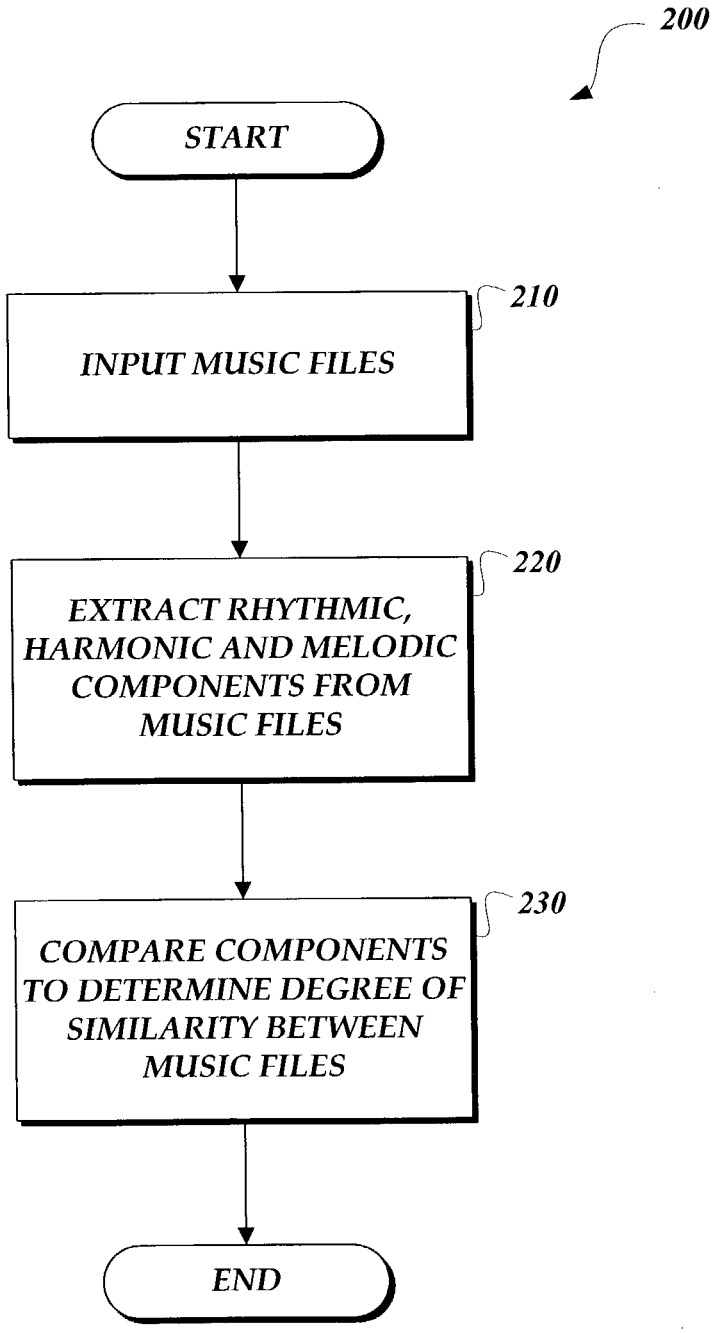
FIG. 2 is a flow diagram illustrative of a general routine for determining the similarity of music files in accordance with the present invention.

FIG. 2 is a flow diagram of a general routine 200 for determining similarity between music files in accordance with the present invention. At a block 210, the music files that are to be evaluated are input into the system. At a block 220, the rhythmic, harmonic, and melodic components are extracted from the music files. At a block 230, the rhythmic, harmonic, and melodic components are compared to determine the degree of similarity between the music files.

As will be described in more detail below, the present invention provides a system and method for extracting and comparing the harmonic, rhythmic, and melodic components of the music files. Earlier systems and methods for providing automatic classification of music files according to various properties are described in U.S. patent application Ser. No. 09/900,059, entitled "System and Methods for Providing Automatic Classification of Media Entities According to Consonance Properties", U.S. patent application Ser. No. 09/935,349, entitled "System and Methods for Providing Automatic Classification of Media Entities According to Sonic Properties", U.S. patent application Ser. No. 09/905,345, entitled "System and Methods for Providing Automatic Classification of Media Entities According to Tempo Properties", and U.S. patent application Ser. No. 09/942,509, entitled "System and Methods for Providing Automatic Classification of Media Entities According to Melodic Movement Properties", all of which are commonly assigned with the present application and all of which are hereby incorporated by reference in their entireties.

Figure 3:
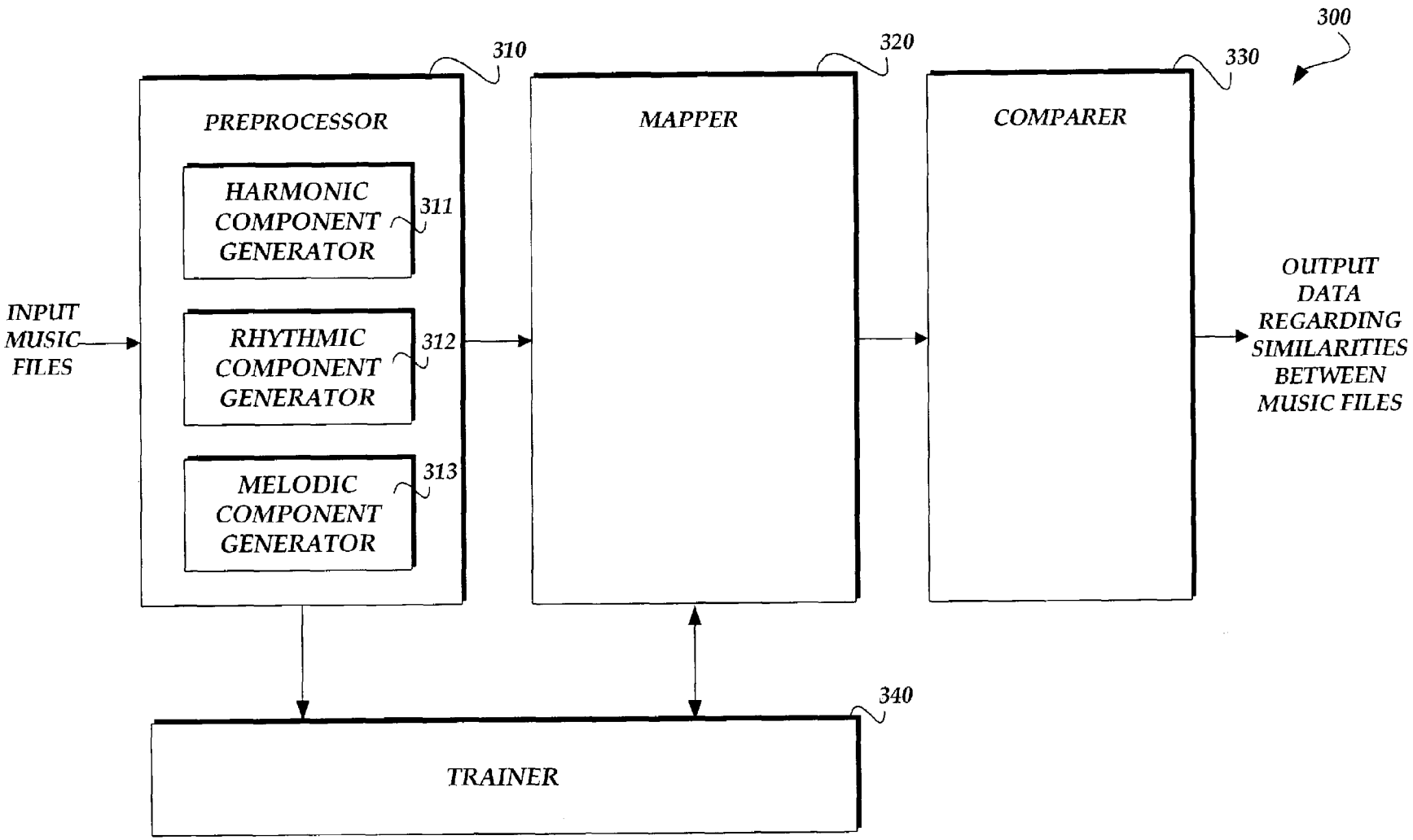
FIG. 3 is a block diagram of a system formed in accordance with the present invention, including a preprocessor, a mapper, a comparer, and a trainer.

FIG. 3 is a block diagram of a system 300 for determining the similarity between music files in accordance with the present invention. The system 300 includes a preprocessor 310, a mapper 320, a comparer 330, and a trainer 340. Music files that are to be evaluated are initially input into the preprocessor 310. The preprocessor 310 includes a harmonic component generator 311, a rhythmic component generator 312, and a melodic component generator 313. As will be described in more detail below, the component generators 311, 312, and 313, return a set of data that represents the three major components of music, including timbre (a.k.a. harmonic), rhythmic, and melodic.

The mapper 320 reduces the dimensionality of the input to six by mapping various found patterns within the output of the component generators 311, 312, and 313 to positions on one of three two-dimensional feature maps. Each of the three feature maps serves their respective component generators. The top N positions in each feature map, along with their amplitudes, are taken as the representative vectors of the input music file.

The comparer 330 compares the similarities between two music files and outputs data regarding the similarities. The comparison is performed by calculating the distance between the two representative vectors of the music files. Small distances indicate that the music files are similar, while large distances indicate that the music files are not similar. Specific numerical examples of this process are provided with respect to FIGS. 8 and 9 below.

The trainer 340 functions to train the feature maps of the mapper 320. In other words, in order to create the mapping of the feature maps, they must be trained. The feature maps are trained at least in part by utilizing a variation of the standard self-organizing feature map (SOFM) training procedure, as is known in the art. The specific operation of the trainer 340 will be described in more detail below with reference to FIG. 7. In general, the outputs of the harmonic component generator 311, the rhythmic component generator 312, and the melodic component generator 313 are repeatedly fed to the trainer 340 for a large corpus of songs (e.g., in one example embodiment, 100,000 songs are used for the training). This process is repeated until the maps converge to stable values. The result of the training process is stored in training files for use by the mapper 320.

Figure 4:
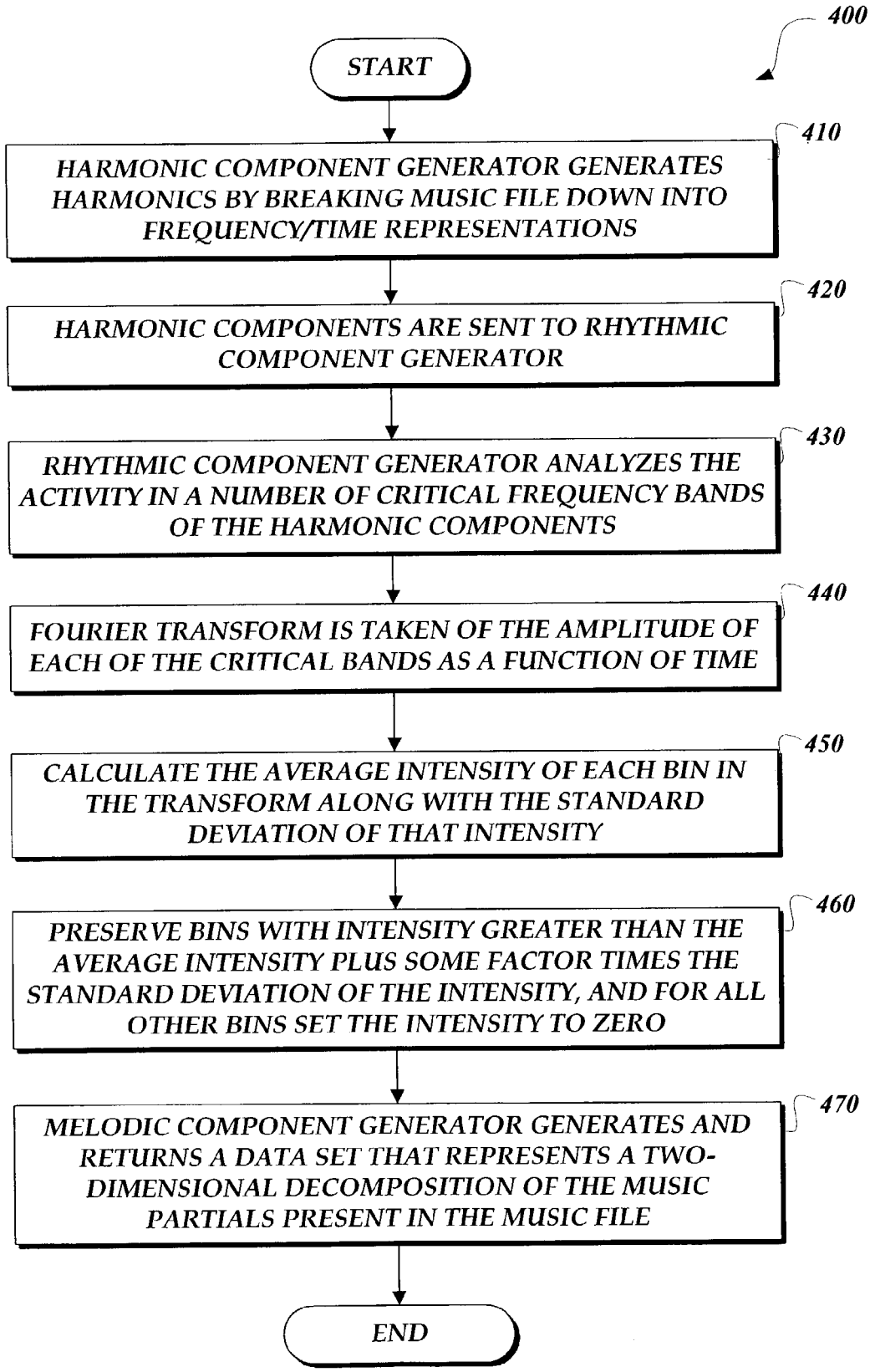
FIG. 4 is a flow diagram illustrative of a routine by which the preprocessor of FIG. 3 generates harmonic, rhythmic, and melodic components.

FIG. 4 is a flow diagram illustrative of a routine 400 showing the operation of the preprocessor 310 of FIG. 3. As illustrated in FIG. 4, at a block 410, the harmonic component generator generates the harmonics of the music file by breaking the music file down into frequency/time representations. The frequency/time representations are a two-dimensional array of numbers. The value of each number represents the energy of the musical signal present in a given frequency bin. The vertical axis is the Mel frequency scale, although the vertical scale can represent any of the many "warped" frequency mappings that are used to more closely mimic the perceptual groupings of frequency bands that occurs in the human ear. The horizontal axis is time.

At a block 420, the harmonic components are sent to the rhythmic component generator. At block 430, the rhythmic component generator analyzes the activity in a number of critical frequency bands of the harmonic components. At block 440, a Fourier transform is taken of the amplitude of each of the critical frequency bands as a function of time. The result of this transform yields information on the period of the periodically occurring signals.

At a block 450, the average intensity of each bin in the transform along with a standard deviation of that intensity is calculated. At a block 460, the bins with intensity greater than the average intensity plus a specified factor times the standard deviation of the intensity are preserved, while all other bins have their intensity set to zero. The result of this truncation is returned by the rhythmic component generator.

At a block 470, the melodic component generator generates and returns a data set that represents a two-dimensional decomposition of the musical partials present in the song. A musical partial is a harmonic component that is stationary for a given period of time. The result of the melodic component generator can be thought of as a primitive musical transcriber; turning the sounds into a rough representation of the notes played in the music. The output of the melodic component generator is described in more detail in the previously incorporated U.S. patent application Ser. Nos. 09/900,059 and 09/942,509. In general, in the operation of the melodic component generator, two 24 element vectors are calculated and combined into one vector. Each element is independently normalized before combination so that its components sum to 1.

Figure 5:
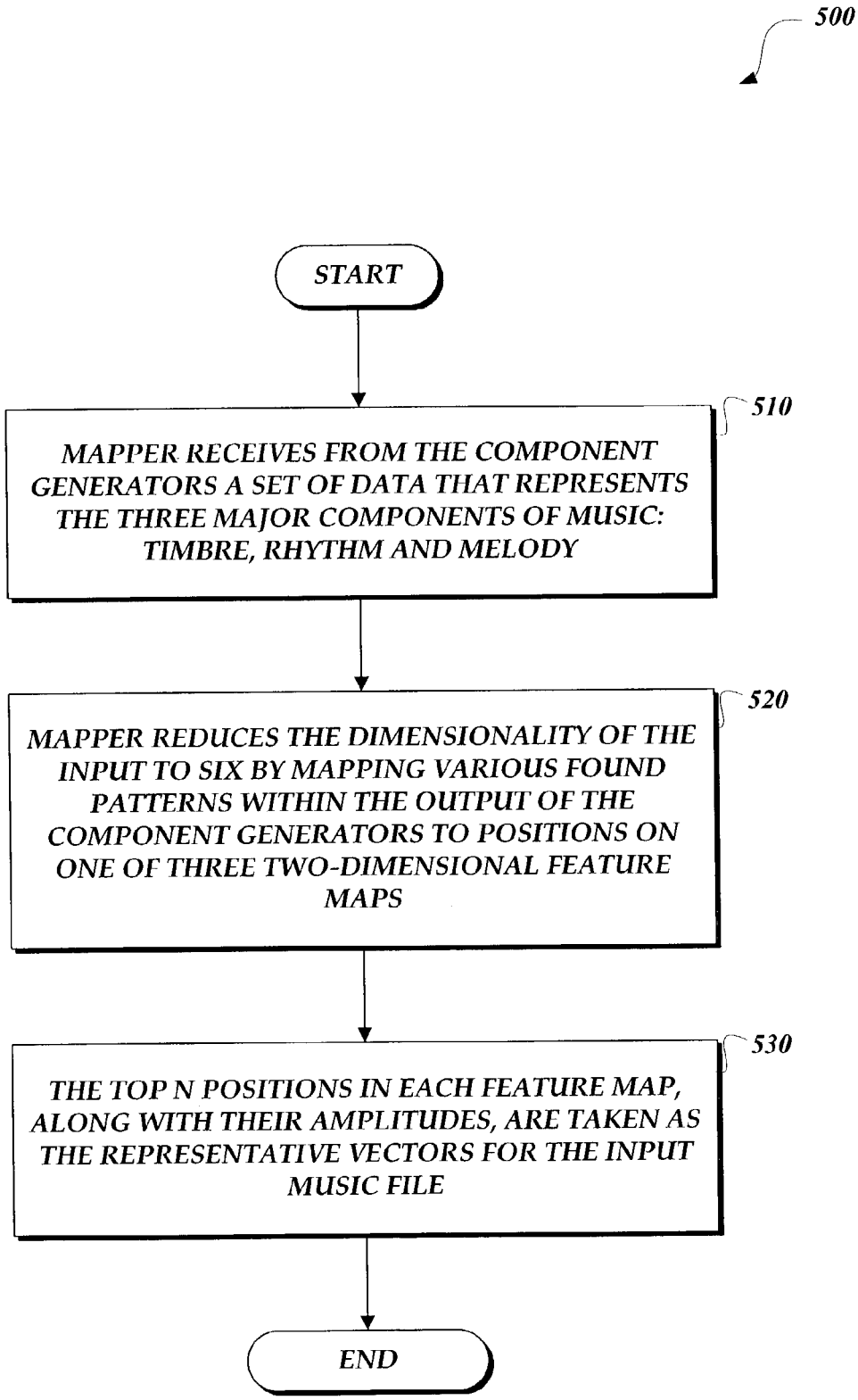
FIG. 5 is a flow diagram illustrative of a routine by which the mapper of FIG. 3 reduces the dimensionality of the input.

FIG. 5 is a flow diagram illustrative of a routine 500 which shows the operation of the mapper 320 of FIG. 3. As shown in FIG. 5, at a block 510, the mapper receives from the component generators a set of data that represents the three major components of a music file, the timbre (a.k.a. harmonics), the rhythm, and the melody. At a block 520, the mapper reduces the dimensionality of the input to six by mapping the various found patterns within the output of the component generators to positions on one of three two-dimensional feature maps. At a block 530, the top N positions in each feature map, along with their amplitudes, are then taken as the representative vectors of the input music file. It should be noted that in this process the output from the harmonic component generator is treated differently than the outputs from the rhythmic and melodic component generators, as will be described in more detail below with reference to FIG. 10.

Figure 6:
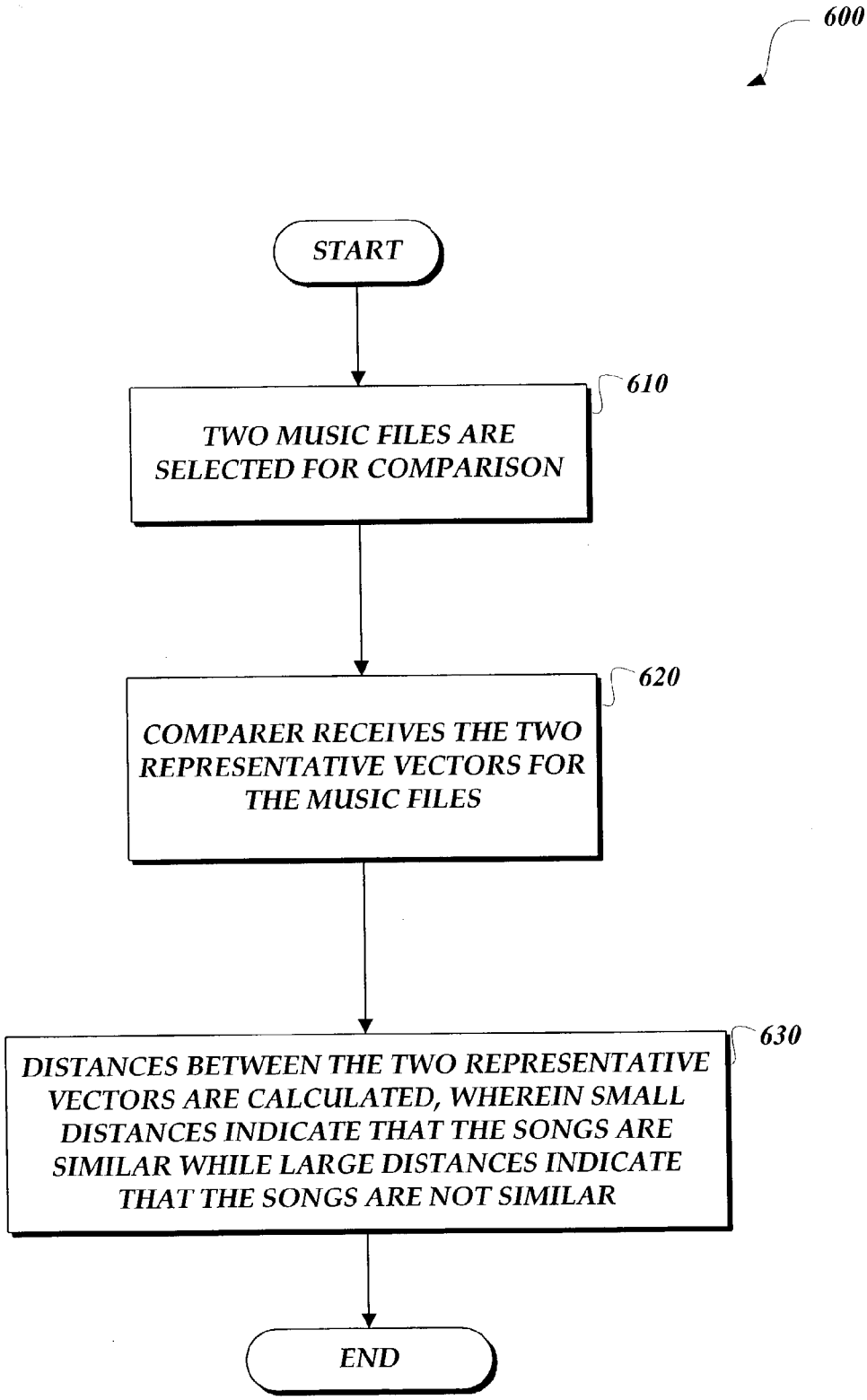
FIG. 6 is a flow diagram illustrative of a routine by which the comparer of FIG. 3 calculates the distance between two representative vectors to determine the similarity between two music files.

FIG. 6 is a flow diagram illustrative of a routine 600 which shows the operation of the comparer 330 of FIG. 3. As shown in FIG. 6, at a block 610 two music files are selected for comparison. At a block 620, the comparer acquires the two representative vectors for the two music files. At a block 630, the distance between the two representative music files are calculated. Small distances indicate that the songs are similar while large distances indicate that the songs are not similar.

Figure 7:
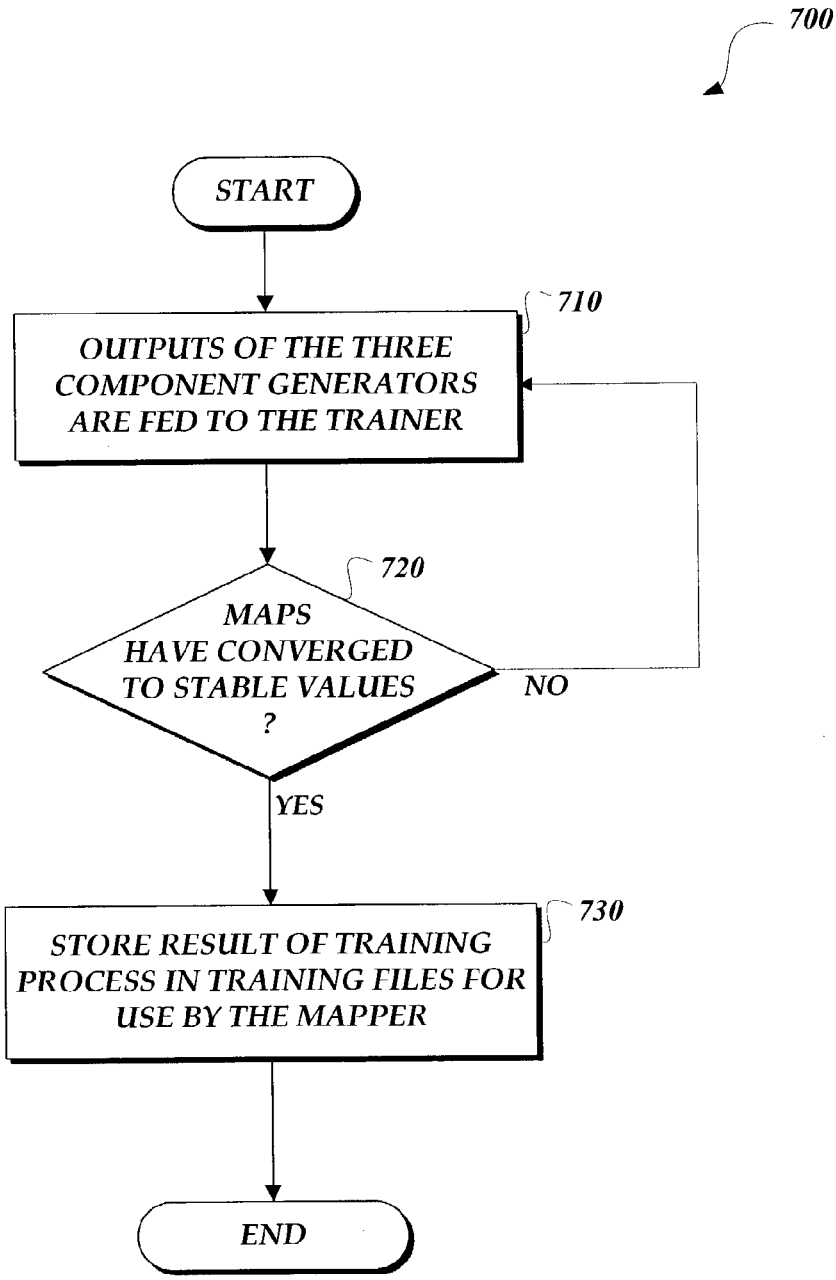
FIG. 7 is a flow diagram illustrative of a routine by which the trainer of FIG. 3 receives the outputs of the three component generators until the feature maps converge to stable values.

FIG. 7 is a flow diagram illustrative of a routine 700 which shows the general operation of the trainer 340 of FIG. 3. As will be described in more detail below, in order to create the mapping of the feature maps, the feature maps must be trained. This is done at least in part by utilizing a variation of the standard self-organizing feature map (SOFM) training procedure, as is known in the art.

As shown in FIG. 7, at a block 710, the outputs of the harmonic component generator, rhythmic component generator, and melodic component generator are fed to the trainer. In one embodiment, the outputs are repeatedly fed to the trainer for a large corpus of music files (e.g., in one example 100,000 music files are used for the training). One epoch represents the presentation of the entire set of music files. This process is may be repeated over several epochs until the maps converge to stable values. Thus, at a decision block 720, a determination is made whether the maps have converged to stable values. If the maps have not yet converged to stable values, then the routine returns to block 710. If the maps have converged to stable values, then the routine continues to a block 730. At block 730, the result of the training process is stored in training files for future use by the mapper.

The operation of the SOFM training procedure that is utilized may be described as follows. The input to each SOFM is the output vectors from the harmonic component generator 311, the rhythmic component generator 312, and the melodic component generator 313. The input vectors are each normalized to unit length in the L1 norm (i.e. the sum of the components equals 1). However, in one embodiment an L2 norm may also be employed (the square root of the sum of the squares of the components equals 1). There is a separate SOFM for the rhythmic and melodic component generators 312 and 313, while the output of the harmonic component generator 311 is fed into two SOFM's. During the training session, the connection weights of each SOFM are initially set to random values between 1 and 0. Over time, the weights converge. In order to maintain topological invariance (i.e. data that is close in the input space is close in the output space), a weighted "winner takes all" training process is used. In this training process, the input neuron with the strongest response is chosen as the winning neuron. The amount of change applied to neurons in the region of the neuron is scaled by $h_ij=\exp(-d_ij/(2s\hat{}2(n))$ where d_i,j is the euclidian distance between cell i, the winning cell, and cell j, a neighboring cell, and $s\hat{}2(n)=s__0*\exp(-n/t)$ where s__0 is an initial scale, n is the iteration number, and t is the scale factor.

FIG. 8 is a table 800 illustrative of pairs of parameters produced by the mapper for selected example songs. For these example values, the example song S1 is "Bye Bye Bye," by N'Sync, which can be classified as bubblegum pop. The example song S2 is "Rein Raus," by Rammstein, which can be classified as metal. The example song S3 is "Zwitter," also by Rammstein, which can also be classified as metal. The example song S4 is "scuse Moi, My Heart," by Collin Raye, which can be classified as contemporary country.

As shown in FIG. 8 values are given for melodic elements M1 and M2, rhythmic elements R1 and R2, and timbre (a.k.a. harmonic) elements T1 and T2 for each of the songs S1, S2, S3, and S4. These numbers are produced by the mapper process above which reduces the dimensionality of the input from the component generators to six parameters that are provided as the pairs of melodic, rhythmic and timbre (a.k.a. harmonic) elements. From the table 800, it can be seen that the songs S2 and S3 (which are by the same artist Rammstein) generally have greater similarities than the songs S1 and S4.

FIG. 9 is a table 900 that shows the perceptual differences between each of the songs S1-S4, where the differences between each of the songs are represented by a single number. Each of the numbers in the matrix 900 represents a distance in the perceptual space. In general, a smaller number indicates perceptually similar items. In the example values of FIG. 9, the values are derived from the pairs of parameters of FIG. 8. In this example, the calculation is done according to the euclidian distance between two points, where "a" and "b" terms indicate two songs a and b, as given by EQUATION 1:

$$((m1a-m1b)^2+(m2a-m2b)^2+(r1a-r1b)^2+(r2A-r2b)^2+(t1a-t1b)^2+(t2a-t2b)^2)^{1/2} \quad \text{(Eq. 1)}$$

As shown in FIG. 9, the songs S2 and S3 (which are both produced by the artist Rammstein) are separated by the smallest distance of 0.238. This indicates that the songs S2 and S3 are more "similar" to one another than to either of the other songs. In contrast, the songs S2 and S4 are separated by the greatest distance of 1.27. This indicates that the songs S2 and S4 are the least "similar" to one another.

Figure 10:
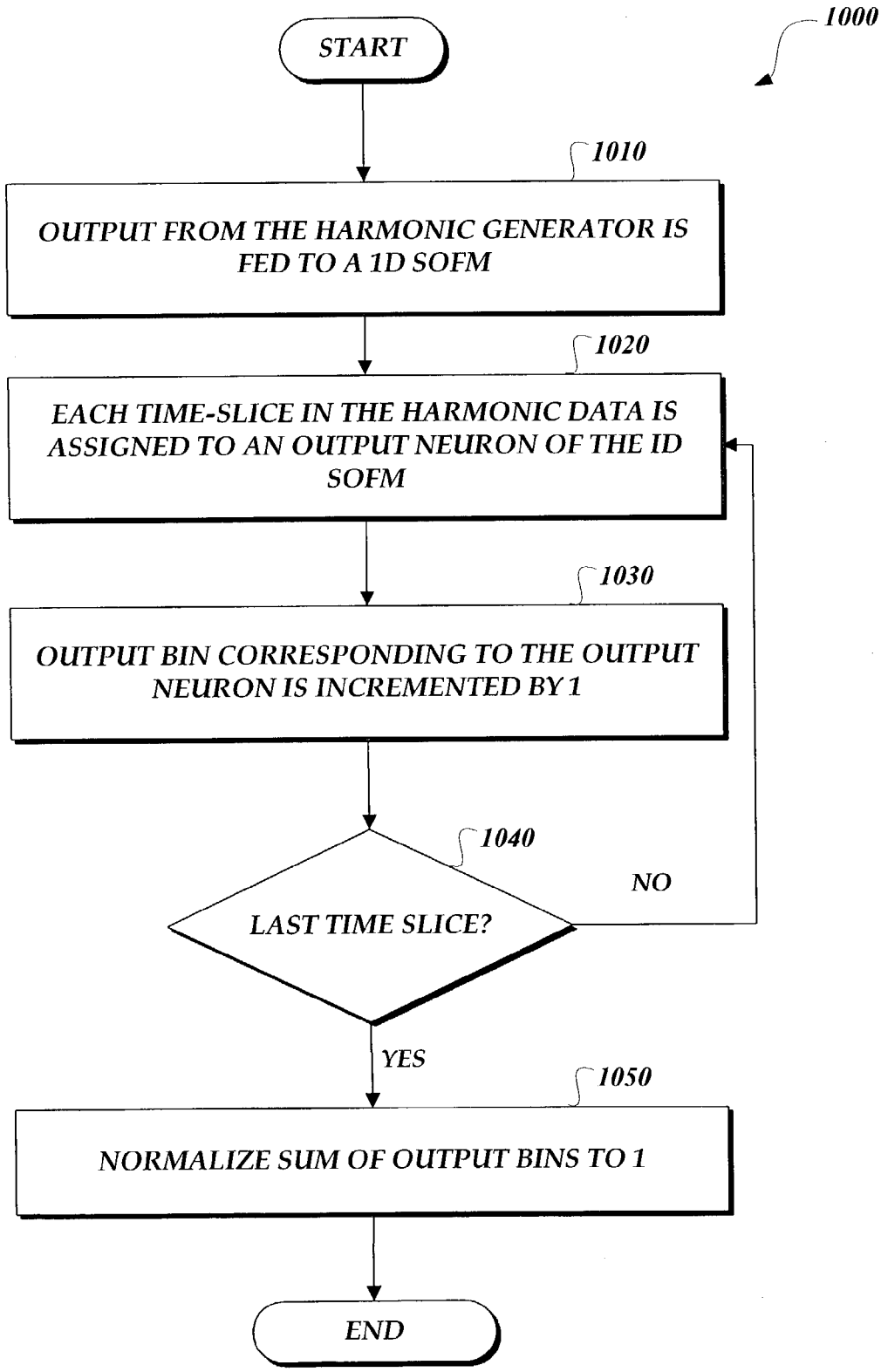
FIG. 10 is a flow diagram illustrative of a routine by which the output of the harmonic generator of FIG. 3 is processed.

FIG. 10 is a flow diagram illustrative of a routine 1000 which shows how the output from the harmonic generator of FIG. 3 is processed differently from the outputs of the rhythmic and melodic component generators. At a block 1010, the output from the harmonic component generator is first fed to a 1d SOFM that was trained as described above with reference to FIG. 7. At a block 1020, each time-slice from the harmonic generator is fed to the 1d SOFM and the output neuron with the strongest response is noted. At a block 1030, each time a neuron responds, a counter corresponding to that neuron is incremented by one. In one embodiment, there are 512 outputs in the 1d SOFM. All counters are initially set to zero.

At a decision block 1040, a determination is made as to whether the last time slice has been processed. If the last time slice has not been processed, then the routine returns to block 1020. If the last time slice has been processed, the routine continues to a block 1050. At block 1050, the sum of the output bins is normalized to 1. Once the entire output from the harmonic component generator is processed, the 512 accumulator bins are presented as the input to a 2d SOFM for final classification in a manner analogous to the output from the other rhythmic and melodic component generators. In one embodiment, the output of each 2d SOFM is a 36 by 36 grid of neurons.

While the preferred embodiment of the invention has been illustrated and described, it will be appreciated that various changes can be made therein without departing from the spirit and scope of the invention.

The invention claimed is:

1. In a computer system, a method for comparing music files, the method comprising:

training a mapper component by scaling an amount of change applied to neurons calculated by taking an exponent of a negative first quotient, a numerator of the first quotient being the euclidian distance between a winning cell and a neighboring cell, a denominator of the first quotient being a first product of two multiplicands, a first multiplicand having a value of 2 and a second multiplicand being a second product of a third and a fourth multiplicand, the third multiplicand being indicative of an initial scale, the fourth multiplicand being an exponent of a negative second quotient, the nominator of the second quotient being an iteration number, and the denominator of the second quotient being a scale factor;

generating rhythmic, harmonic, and melodic components from the music files;

processing the rhythmic, harmonic, and melodic components to determine representative vectors for the music files by reducing dimensionality of the rhythmic, harmonic, and melodic components to six and mapping the rhythmic, harmonic, and melodic components to two-dimensional feature maps; and comparing the representative vectors, the comparison of the representative vectors providing an indication of a degree of similarity between the music files.

2. The method of claim 1, wherein the representative vectors are determined based on the two-dimensional feature maps.

3. The method of claim 2, wherein the representative vectors are determined by taking a selected number of the top positions in each of the two-dimensional feature maps along with their amplitudes.

4. The method of claim 2, wherein the comparison of the representative vectors comprises calculating the distance between the representative vectors.

5. The method of claim 1, wherein the processing of the rhythmic, harmonic, and melodic components produces fewer than six elements that are representative of each of the music files.

6. The method of claim 1, wherein the feature maps are trained by utilizing a training procedure which is performed for a selected number of iterations so as to cause the feature maps to converge toward stable values.

7. The method of claim 6, wherein the training procedure comprises a self-organizing feature map training procedure.

8. The method of claim 6, wherein the results of the training procedure are stored in training files for use during the mapping process.

9. The method of claim 1, wherein the generation of the harmonic components is performed by processing the music files to produce frequency/time representations.

10. The method of claim 9, wherein the vertical axis of the frequency/time representations represents a parameter that mimics the perceptual groupings of frequency bans that occur in the human ear.

11. The method of claim 10, wherein the vertical axis comprises the Mel frequency scale.

12. The method of claim 1, wherein the rhythmic components are generated by analyzing a selected number of critical frequency bands of the harmonic components.

13. The method of claim 12, wherein the generation of the rhythmic components comprises taking a time-frequency decomposition of the amplitude of each of the selected critical frequency bands of the harmonic components as a function of time, which yields information regarding the period of the periodically occurring signals.

14. The method of claim 13, wherein the average intensity of each bin in the Fourier transform along with the standard deviation of that intensity is calculated, and the bins with intensity greater than the average intensity plus a specified factor times the standard deviation of the intensity are preserved, while all other bins have their intensity set to zero.

15. The method of claim 1, wherein the melodic components are generated by determining a data set that represents a two-dimensional decomposition of the musical partials present in each music file, the music partials being harmonic components that are stationary for a given period of time.

16. A computer-readable medium having computer-executable components for implementing a method for comparing musical files, the method comprising:

training a mapper component by scaling an amount of change applied to neurons calculated by taking an exponent of a negative first quotient, a numerator of the first quotient being the euclidian distance between a winning cell and a neighboring cell, a denominator of the first quotient being a first product of two multiplicands, a first multiplicand having a value of 2 and a second multiplicand being a second product of a third and a fourth multiplicand, the third multiplicand being indicative of an initial scale, the fourth multiplicand being an exponent of a negative second quotient, the nominator of the second quotient being an iteration number, and the denominator of the second quotient being a scale factor;

generating timbre, rhythm, and melody components from the musical files;

processing the timbre, rhythm, and melody components to determine representative vectors for the music files by reducing dimensionality of the plurality of components to six, mapping the plurality of components to two-dimensional feature maps, and taking top positions in each two-dimensional feature maps; and comparing the representative vectors.

17. The method of claim 16, wherein the representative vectors are determined based on the two-dimensional feature maps.

18. The method of claim 17, wherein the representative vectors are determined by taking a selected number of the top positions in each of the two-dimensional feature maps along with their amplitudes.

19. The method of claim 17, wherein the comparison of the representative vectors comprises calculating the distance between the representative vectors.

20. The method of claim 16, wherein the processing of the timbre, rhythm, and melody components produces fewer than six elements that are representative of each of the music files.

21. The method of claim 16, wherein the feature maps are trained by utilizing a training procedure which is performed for a selected number of iterations so as to cause the feature maps to converge toward stable values.

22. The method of claim 21, wherein the training procedure comprises a self-organizing feature map training procedure.

23. The method of claim 21, wherein the results of the training procedure are stored in training files for use during the mapping process.

24. A system for comparing music files, comprising:

a trainer component for training a mapper component by scaling an amount of change applied to neurons calculated by taking an exponent of a negative first quotient, a numerator of the first quotient being the euclidian distance between a winning cell and a neighboring cell, a denominator of the first quotient being a first product of two multiplicands, a first multiplicand having a value of 2 and a second multiplicand being a second product of a third and a fourth multiplicand, the third multiplicand being indicative of an initial scale, the fourth multiplicand being an exponent of a negative second quotient, the nominator of the second quotient being an iteration number, and the denominator of the second quotient being a scale factor;

a means for generating a plurality of components from the music files, the means for generating the plurality of components comprising a harmonic component generator, a rhythmic component generator, and a melodic component generator;

a means for training a mapping of two-dimensional feature maps by taking output vectors from the harmonic component generator and presenting them to a rhythmic self organizing feature map and a melodic self organizing feature map, the means for training further taking output vectors from the rhythmic component generator and presenting them to the rhythmic self organizing feature map, the means for training yet further taking output vectors from the melodic component generator and presenting them to the melodic self organizing feature map;

a means for processing the plurality of components to determine representative vectors for the music files by reducing dimensionality of the plurality of components to six and mapping the plurality of components to two-dimensional feature maps; and a means for comparing the representative vectors.

25. The system of claim 24, wherein the means for processing the plurality of components comprises a mapper.

26. The system of claim 25, wherein the representative vectors are determined by taking a selected number of top positions in each of the two-dimensional feature maps along with their amplitudes.

27. The system of claim 25, wherein the means for comparing the representative vectors calculates the distance between the representative vectors.

28. The system of claim 24, wherein for each of the harmonic, rhythmic, and melodic components, two or fewer elements are produced that are representative of each of the music files.

29. The system of claim 25, wherein the results of the training procedure are stored in training files for use by the mapper means.

30. In a computer system with a memory for storing music files, a computer-readable medium having computer-executable components, the computer-executable components comprising:

a preprocessor component for generating components of the music files;

a mapper component for mapping the components of the music files by reducing dimensionality of the components to six and mapping the components to two-dimensional feature maps, the maps being utilized to determine representative vectors for each of the music files; and a training component for training a mapper component by scaling an amount of change applied to neurons calculated by taking an exponent of a negative first quotient, a numerator of the first quotient being the euclidian distance between a winning cell and a neighboring cell, a denominator of the first quotient being a first product of two multiplicands, a first multiplicand having a value of 2 and a second multiplicand being a second product of a third and a fourth multiplicand, the third multiplicand being indicative of an initial scale, the fourth multiplicand being an exponent of a negative second quotient, the nominator of the second quotient being an iteration number, and the denominator of the second quotient being a scale factor.

31. The computer-readable components of claim 30, further comprising a comparer component for calculating the distance between the representative vectors.

32. The computer-readable components of claim 31, wherein the trainer component utilizes a self-organizing feature map training procedure.

33. The computer-readable components of claim 31, wherein the training component performs a training process that causes the maps to converge toward stable values.

34. The computer-readable components of claim 33, wherein the result of the training process is stored in training files for use by the mapper component.

35. The computer-readable components of claim 30, wherein the preprocessor component comprises a harmonic component generator, a rhythmic component generator, and a melodic component generator.

36. The computer-readable components of claim 35, wherein for each of the harmonic, rhythmic, and melodic components, two or fewer numerical elements are produced for representing each of the music files.

37. The computer-readable components of claim 30, wherein a total of fewer than six elements are produced that are representative of each of the music files.

38. A system for comparing musical files, comprising:

a preprocessor means for generating components of the music files;

a mapper means for mapping the components of the music files by reducing dimensionality of the components to six parameters that are pairs of melodic, rhythmic, and timbre, and mapping the components to two-dimensional feature maps; and a trainer component for training the mapper means by scaling an amount of change applied to neurons calculated by taking an exponent of a negative first quotient, a numerator of the first quotient being the euclidian distance between a winning cell and a neighboring cell, a denominator of the first quotient being a first product of two multiplicands, a first multiplicand having a value of 2 and a second multiplicand being a second product of a third and a fourth multiplicand, the third multiplicand being indicative of an initial scale, the fourth multiplicand being an exponent of a negative second quotient, the nominator of the second quotient being an iteration number, and the denominator of the second quotient being a scale factor.

39. The system of claim 38, wherein the maps are utilized to determine representative vectors for each of the music files.

40. The system of claim 39, further comprising a comparer means to calculate the distance between the representative vectors of the music files, the distance providing an indication of the degree of similarity between the music files.

41. The system of claim 38, further comprising a trainer means for training the mapper means.

42. The system of claim 38, wherein the preprocessor means comprises a harmonic component generator means, a rhythmic component generator means, and a melodic component generator means.

43. The system of claim 42, wherein for each of the harmonic, rhythmic, and melodic components, two or fewer numerical elements are produced that are representative of each of the music files.

44. The system of claim 38, wherein the mapper means reduces the dimensionality of the components to fewer than six elements for each music file.

* * * * *